United States Patent [19]

Milnes

[11] Patent Number: 5,026,009

[45] Date of Patent: Jun. 25, 1991

[54] METHOD FOR TRACKING TRAINS THROUGH MULTIPLE FALSE TRACK CIRCUIT OCCUPANCIES

[75] Inventor: Robert D. Milnes, Pittsburgh, Pa.

[73] Assignee: AEG Westinghouse Transportation Systems, Inc., Pittsburgh, Pa.

[21] Appl. No.: 385,196

[22] Filed: Jul. 26, 1989

[51] Int. Cl.[5] ..... B61L 25/02; B61L 27/00

[52] U.S. Cl. ..... 246/122 R; 246/2 S; 246/5; 246/28 F

[58] Field of Search ..... 246/122 R, 5, 2 R, 2 S, 246/3, 5, 20, 27, 28 R, 28 F, 122 R, 123; 364/450

[56] References Cited

U.S. PATENT DOCUMENTS

| | | | |
|---|---|---|---|
| 3,601,602 | 8/1971 | Smith | 246/122 R X |
| 3,757,112 | 9/1973 | Lehmann | 246/122 R |
| 3,901,468 | 8/1975 | Cochran et al. | 246/28 R X |
| 4,023,753 | 5/1977 | Dobler | 246/5 |
| 4,038,653 | 7/1977 | Brewster | 246/122 R X |
| 4,361,300 | 11/1982 | Rush | 246/5 |
| 4,361,301 | 11/1982 | Rush | 246/34 |
| 4,407,470 | 10/1983 | Gilcher | 246/122 R X |
| 4,787,581 | 11/1988 | Dobler et al. | 246/122 R X |

*Primary Examiner*—Robert J. Spar
*Assistant Examiner*—Scott L. Lowe
*Attorney, Agent, or Firm*—Spencer & Frank

[57] ABSTRACT

A central control system includes a method for monitoring a plurality of trains throughout a transit system having computer for maintaining a train location table tracking the location of the trains throughout the system and for detecting and recording false train occupancy indications. The system is designed to handle a large number of false occupancy designations and to associate each train with a physical track circuit location.

2 Claims, 1 Drawing Sheet

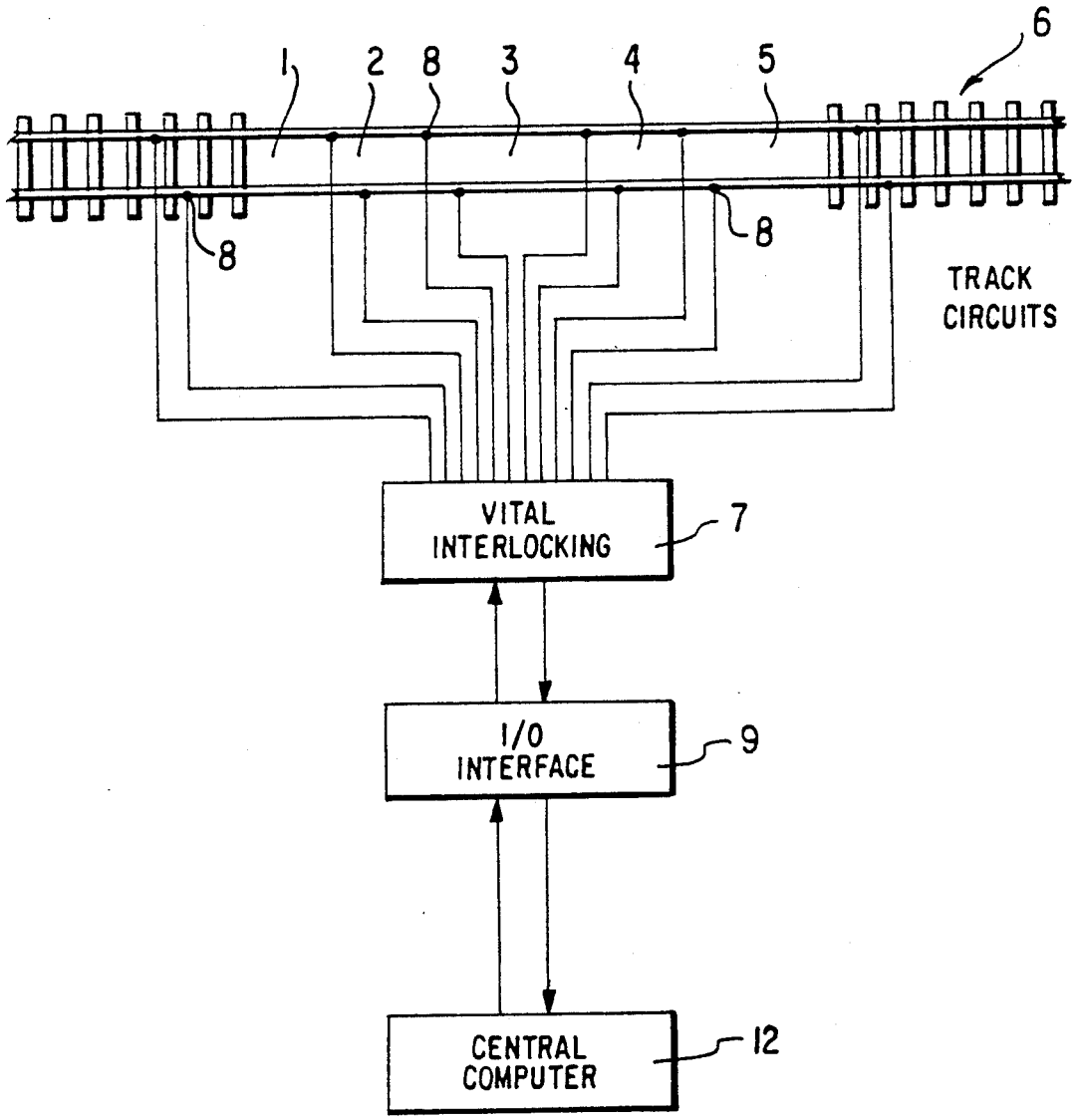
6
1
2
8
3
4
5
8
8
TRACK
CIRCUITS
VITAL
INTERLOCKING
7
I/O
INTERFACE
9
CENTRAL
COMPUTER
12

METHOD FOR TRACKING TRAINS THROUGH MULTIPLE FALSE TRACK CIRCUIT OCCUPANCIES

CROSS-REFERENCE TO RELATED APPLICATIONS

This application is related to copending patent application Ser. No. 07/180,702 filed Apr. 5th, 1988, titled "TRAIN MONITOR DETECTION APPARATUS" by Donald L. Rush et al., and assigned to the same assignee as the present application.

BACKGROUND OF THE INVENTION

The present invention relates to central control systems for monitoring the location of a plurality of trains within a transit system. More particularly, the present invention relates to a centralized electronic control system which utilizes interlocking circuits and false occupancy correction factors to monitor train locations.

Central tracking systems monitor a number of trains along a transit system by assigning train designators to individual trains and section designators to individual sections of the track throughout the transit system and by monitoring the occupancy of those track section by the various trains in the system. If a particular train is in a particular track section, that section is said to be occupied. The presence of a train within the section will trigger a sensor in the track, alerting the control system which will alert the central control computer that that portion of the track is occupied. However, it occasionally arises that a section of the track system will indicate occupancy when in fact that portion of the track system is not occupied, this is referred to as a false occupancy.

A false occupancy occurs when a track circuit signals an occupancy at a location where the central control system does not expect an occupancy to occur. In situations where track circuits on both sides of a newly received occupancy signal ere previously unoccupied, the control system does not expect an occupancy to occur. The central control system will therefore classify this type of an occupancy as a potential false occupancy.

A false occupancy can be caused by a variety of different factors, such as input/output (I/O) failure, signal wire failure or an external event that may cause a track to become shorted or the track circuit to become shorted. In a train control system with automatic train control, a false occupancy will not allow other trains to proceed through the falsely occupied section of track as long as the cause of the occupancy indication signal is unknown.

The methods utilized by existing track control systems present limitations in the presence of false occupancies. Once a false occupancy has been located at a particular track section, a train cannot be tracked through the section. The presence of the false occupancy will obscure tracking of the train. There is a maximum number of false occupancies that can be accommodated by a system. When a system becomes overloaded with a greater number of false occupancies, train tracking becomes impossible.

SUMMARY OF THE INVENTION

It is an object of the present invention to provide a method for monitoring track occupancy signals which can accommodate any number of false occupancy signals.

It is another object of the present invention to provide a method for monitoring track occupancy signals which can monitor trains as they pass through portions of the track which register false occupancies.

It is a further object of the present invention to provide a method for central track control which monitors a plurality of track sections of a transit system for determining train location within a system and for monitoring and accommodating false occupancies, which can be implemented on existing central track control systems.

These and other objects of the present invention are accomplished by providing a central track control system which assigns individual codes to false occupancies in a train location table, monitors the approach of actual trains to the false occupancy sites, replaces the false occupancy code with the approaching train number as the train crosses through the false occupancy site, stores the false occupancy code in an indexed location and restores the false occupancy code after the train has passed the false occupancy site.

BRIEF DESCRIPTION OF THE DRAWINGS

The invention will now be described with reference to the following drawings illustrating an exemplary embodiment thereof.

FIG. 1 is a schematic diagram of a transit system and a central control system therefore.

DETAILED DESCRIPTION OF AN EXEMPLARY EMBODIMENT

As illustrated in FIG. 1, each track 6 of the transit system is divided into a number of circuits or sections, 1-5. The track sections are independently connected to a vital interlocking mechanism 7 which detects the actuation of the sensors 8 stationed along the track system at the boundaries of the various track sections. An I/O interface 9 links the interlocking mechanism 7 with the central computer 12. As a train passes along the track into and out of a particular section, its location is noted and the central computer system 12 records the occupation of the particular section by the particular train.

In the system according to the present invention, the individual trains are tracked in a table, each train designated by an assigned number or code. As a train is detected within the system, a code corresponding to the train is stored in a train location table. The codes can be arbitrarily assigned to individual trains or specifically assigned by the system operator. In this manner, the location of each train as it passes through the transit system is continuously monitored.

The system of the present invention also keeps track of the occurrence of false occupancies. As false occupancies are determined, they are given a special code and stored within the train location table.

When a track circuit on either side of a false occupancy location becomes occupied with a train, the original false occupancy designation number is shifted from the train location table to a false occupancy location table at a position indexed to its position in the train location table. The number of the adjacent train is substituted into the train location table at the former position of the false occupancy number. The entry in the train location table at the index location of a false occupancy code number is thereby replaced with the train code number of the train on the occupied track circuit next to the false occupancy location. In this manner the train designator is recorded both at its location and at the adjacent location where the false occupancy was previously recorded.

In the case where false occupancies occupy adjacent track circuit locations, the actual train number is substituted for all of the false occupancies simultaneously as the train occupies a circuit position adjacent either end of the false occupancies. Once the train has passed through the false occupancy locations, and the train is now occupying a non-adjacent section on the other side of the false occupancy or occupancies, the train location is only recorded at this section and the special false occupancy numbers are shifted back into the train location table and removed from the false occupancy location table. With the above described recordation method, the real train number is always associated with at least one physical track circuit and is never hidden behind a false occupancy code identifier which may have occupied the track circuit before the train.

The following charts illustrate a number of examples of the operation of the present invention with one, two, and three false occupancies respectively. Table I consists of a series of seven frames, illustrating the progression from no trains or false occupancies to one false occupancy, with the travel of a train from track section 1 through track section 5.

In each of the frames, the status of track sections 1–5 is indicated by the designations in the train location column and the false location column, respectively. In the first frame there are no train occupancy indications or false occupancy indications detected by the central monitoring system. Frame 2 indicates the detection of a false occupancy in track section number 3. This false occupancy detection has been arbitrarily assigned number 999 and is indicated by the 999 at the location indexed by track section 3 in frame 2.

In frame 3, the approach of train number 10 has been detected and indicated by the designation "10" in index position 1 corresponding to track section 1 in the train location table. As the train 10 approaches track section 3 which has the false designation 999, the train designator 10 is moved to track section 2 as indicated in frame 4. Once the train has reached the occupancy location of track section 2, the adjacent track section false occupancy 999 is replaced with an occupancy designator "10", and the false occupancy designator 999 is moved to the false occupancy location column as illustrated in frame 4.

Next, as the train leaves track section 2, the "10" designator is removed from the train location column in the index position corresponding to track section 2, but is maintained in the index 3 position. The train 10 is presumed to have travelled into track section 3, however, as this track section is providing a false occupancy designation, the system cannot detect the presence of train 10 in track circuit 3. Therefore, the designator "10" is left in this location on the presumption that this is now the true location of train 10.

In frame 6, train 10 has been detected in track section 4 and the designator "10" is therefore added to the train location column of the table at index position 4. The train designator 10 is maintained at index position 3 where the false occupancy signal is still being received. As the train leaves track section 4 and is now detected at track section 5, the designator 10 is moved to the appropriate index position 5, as indicated in frame 7 of table 1, and the train designator 10 at track index location 3 is replaced with the false occupancy designator 999 in the train location column. The false location column is then emptied and no longer indicates detection of any false occupancies, as the false occupancy detection is now indicated in the train location table.

TABLE I

| Frame | Track Circuit | Train Loc. | False Loc. | |
|---|---|---|---|---|
| I | 1 | 0 | 0 | |
| | 2 | 0 | 0 | |
| | 3 | 0 | 0 | |
| | 4 | 0 | 0 | |
| | 5 | 0 | 0 | |
| II | 1 | 0 | 0 | |
| | 2 | 0 | 0 | |
| | 3 | 999 | 0 | false occupy. |
| | 4 | 0 | 0 | |
| | 5 | 0 | 0 | |
| III | 1 | 10 | 0 | real train occup. |
| | 2 | 0 | 0 | |
| | 3 | 999 | 0 | false occup. |
| | 4 | 0 | 0 | |
| | 5 | 0 | 0 | |
| IV | 1 | 0 | 0 | |
| | 2 | 10 | 0 | real train occup. |
| | 3 | 10 | 999 | false & real occup. |
| | 4 | 0 | 0 | |
| | 5 | 0 | 0 | |
| V | 1 | 0 | 0 | |
| | 2 | 0 | 0 | |
| | 3 | 10 | 999 | false & real occup. |
| | 4 | 0 | 0 | |
| | 5 | 0 | 0 | |
| VI | 1 | 0 | 0 | |
| | 2 | 0 | 0 | |
| | 3 | 10 | 999 | false & real occup. |
| | 4 | 10 | 0 | real train occup. |
| | 5 | 0 | 0 | |
| VII | 1 | 0 | 0 | |
| | 2 | 0 | 0 | |
| | 3 | 999 | 0 | false occup. |
| | 4 | 0 | 0 | |
| | 5 | 10 | 0 | real train occup. |

Table II similarly illustrates the progression of a train through 6 track sections or circuits, wherein false designations have been detected at track sections 3 and 4 and have been given designators 999 and 998, respectively. The train again, is illustrated as entering track section 1 passing through track sections 3 and 4 and exiting track section 6.

As can be observed, the designators for false train occupancy are switched to the designator corresponding to the train once the train has approached and occupies the adjacent track section. This switched designation is maintained until the train leaves the adjacent section as it moves away from the false designating section. The false designators are moved to the false location column of the table as the train passes through the false zones and are replaced after the train has left as described above.

TABLE II

| Track Circuit | Train Loc. | False Loc. | |
|---|---|---|---|
| 1 | 0 | 0 | |
| 2 | 0 | 0 | |
| 3 | 0 | 0 | |
| 4 | 0 | 0 | |
| 5 | 0 | 0 | |
| 6 | 0 | 0 | |
| 1 | 0 | 0 | |
| 2 | 0 | 0 | |
| 3 | 999 | 0 | false occup. |
| 4 | 998 | 0 | false occup. |
| 5 | 0 | 0 | |
| 6 | 0 | 0 | |

TABLE II-continued

| Track Circuit | Train Loc. | False Loc. | |
|---|---|---|---|
| 1 | 10 | 0 | real train occup. |
| 2 | 0 | 0 | |
| 3 | 999 | 0 | false occup. |
| 4 | 998 | 0 | false occup. |
| 5 | 0 | 0 | |
| 6 | 0 | 0 | |
| 1 | 0 | 0 | |
| 2 | 10 | 0 | real train occup. |
| 3 | 10 | 999 | false & real occup. |
| 4 | 10 | 998 | false & real occup. |
| 5 | 0 | 0 | |
| 6 | 0 | 0 | |
| 1 | 0 | 0 | |
| 2 | 0 | 0 | |
| 3 | 10 | 999 | false & real occup. |
| 4 | 10 | 998 | false & real occup. |
| 5 | 0 | 0 | |
| 6 | 0 | 0 | |
| 1 | 0 | 0 | |
| 2 | 0 | 0 | |
| 3 | 10 | 999 | false & real occup. |
| 4 | 10 | 998 | false & real occup. |
| 5 | 0 | 0 | |
| 6 | 0 | 0 | |
| 1 | 0 | 0 | |
| 2 | 0 | 0 | |
| 3 | 10 | 999 | false & real occup. |
| 4 | 10 | 998 | false & real occup. |
| 5 | 10 | 0 | real train occup. |
| 6 | 0 | 0 | |
| 1 | 0 | 0 | |
| 2 | 0 | 0 | |
| 3 | 999 | 0 | false occup. |
| 4 | 998 | 0 | false occup. |
| 5 | 0 | 0 | |
| 6 | 10 | 0 | real train occup. |

Table III illustrates the passage of a train in a manner similar to Tables I and II, however, seven track sections are illustrated and three adjacent false occupancy detections are illustrated. The method of indicating the approach and passage of the train through the false occupancy track sections is the same as that explained above.

TABLE III

| Track Circuit | Train Loc. | False Loc. | |
|---|---|---|---|
| 1 | 0 | 0 | |
| 2 | 0 | 0 | |
| 3 | 0 | 0 | |
| 4 | 0 | 0 | |
| 5 | 0 | 0 | |
| 6 | 0 | 0 | |
| 7 | 0 | 0 | |
| 1 | 0 | 0 | |
| 2 | 0 | 0 | |
| 3 | 999 | 0 | false occup. |
| 4 | 998 | 0 | false occup. |
| 5 | 997 | 0 | false occup. |
| 6 | 0 | 0 | |
| 7 | 0 | 0 | |
| 1 | 10 | 0 | real train occup. |
| 2 | 0 | 0 | |
| 3 | 999 | 0 | false occup. |
| 4 | 998 | 0 | false occup. |
| 5 | 997 | 0 | false occup. |
| 6 | 0 | 0 | |
| 7 | 0 | 0 | |
| 1 | 0 | 0 | |
| 2 | 10 | 0 | real train occup. |
| 3 | 10 | 999 | false occup. |
| 4 | 10 | 998 | false occup. |
| 5 | 10 | 997 | false occup. |
| 6 | 0 | 0 | |
| 7 | 0 | 0 | |

TABLE III-continued

| Track Circuit | Train Loc. | False Loc. | |
|---|---|---|---|
| 1 | 0 | 0 | |
| 2 | 0 | 0 | |
| 3 | 10 | 999 | false & real occup. |
| 4 | 10 | 998 | false & real occup. |
| 5 | 10 | 997 | false & real occup. |
| 6 | 0 | 0 | |
| 7 | 0 | 0 | |
| 1 | 0 | 0 | |
| 2 | 0 | 0 | |
| 3 | 10 | 999 | false & real occup. |
| 4 | 10 | 998 | false & real occup. |
| 5 | 10 | 997 | false & real occup. |
| 6 | 0 | 0 | |
| 7 | 0 | 0 | |
| 1 | 0 | 0 | |
| 2 | 0 | 0 | |
| 3 | 10 | 999 | false & real occup. |
| 4 | 10 | 998 | false & real occup. |
| 5 | 10 | 997 | false & real occup. |
| 6 | 0 | 0 | |
| 7 | 0 | 0 | |
| 1 | 0 | 0 | |
| 2 | 0 | 0 | |
| 3 | 10 | 999 | false & real occup. |
| 4 | 10 | 998 | false & real occup. |
| 5 | 10 | 997 | false & real occup. |
| 6 | 10 | 0 | real train occup. |
| 7 | 0 | 0 | |
| 1 | 0 | 0 | |
| 2 | 0 | 0 | |
| 3 | 999 | 0 | false occup. |
| 4 | 998 | 0 | false occup. |
| 5 | 997 | 0 | false occup. |
| 6 | 0 | 0 | |
| 7 | 10 | 0 | real train occup. |

The change in the software necessary to implement the present invention into existing central control computers for transit systems requires the addition of the handling of a false location column within the train monitoring and location indication tables. In this manner, the location of a train will always be associated with a physical track location, and will not be masked by false occupancy detection indications.

It will be understood that the above description of the present invention is susceptible to various modifications, changes and adaptations, and the same are intended to be comprehended within the meaning and range of equivalents of the appended claims.

What is claimed is:

1. In a centralized electronic control system, having a computer which maintains a train location table for monitoring train locations along track sections of a transit system by assigning train designators to individual trains and section designators to individual track sections, and monitors the occupancy of track sections by trains such that the presence of a train within a track section will cause said computer to store the train designators in said train location table at locations associated with appropriate track section designators, a computer based method of handling false occupancies, a false occupancy being an indication in said train location table of occupancy of a track section when it is not actually occupied, occurring when a track circuit signals and occupancy at a track section where the system does not expect an occupancy to occur, said computer based method comprising the steps of:

assigning and storing an individual false occupancy code for each false occupancy in said train location table;

monitoring the approach of any train to any track section indicating a false occupancy;

replacing the false occupancy code associated with the track section with the approaching train's designator when the train enters a track section adjacent to it and simultaneously storing the false occupancy code in an indexed false occupancy location table; and restoring the false occupancy code to said train location table after the train has passed the track section on the other side of the track section associated with the false occupancy code.

2. The method of claim 1, wherein if a plurality of false occupancy codes are present at adjacent locations in said train location table, corresponding to adjacent track sections, said step of replacing replaces all of the plurality of adjacent false occupancy codes with said approaching train's designator and simultaneously stores said plurality of adjacent false occupancy codes in said indexed false occupancy location table, when said train enters a track section adjacent to a first one of the track sections associated with the adjacent false occupancy codes; and said step of restoring restores all of said adjacent false occupancy codes to said train location table when said train has passed the track section on the other side of the track section associated with a last of said adjacent false occupancy codes.

* * * * *